United States Patent [19]

Lingaraju

[11] 4,293,172

[45] Oct. 6, 1981

[54] CASE FOR ELECTRICAL MULTIPLE OUTLET

[75] Inventor: Bhartoor Lingaraju, Allentown, Pa.

[73] Assignee: Square D Company, Palatine, Ill.

[21] Appl. No.: 88,195

[22] Filed: Oct. 23, 1979

[51] Int. Cl.[3] ..... H01R 4/66; H01R 13/514

[52] U.S. Cl. ..... 339/14 P; 339/159 C

[58] Field of Search ..... 339/14 R, 14 P, 159 C

[56] References Cited

U.S. PATENT DOCUMENTS 3,034,084 5/1962 Schmier et al. ..... 339/159 C X

FOREIGN PATENT DOCUMENTS 466935 6/1937 United Kingdom ..... 339/159 C
684109 12/1952 United Kingdom ..... 339/159 C
927074 5/1963 United Kingdom ..... 339/159 C

*Primary Examiner*—Eugene F. Desmond

*Attorney, Agent, or Firm*—John R. Garrett; Carmen B. Patti; Richard T. Guttman

[57] ABSTRACT

This disclosure depicts a novel improved thin wall correlative case for use with an electrical multiple outlet. The correlative case comprises: a bottom section and a top section, each of the top and bottom sections having; a floor, first and second side walls, and first and second end walls, and first and second substantially rectangular apertures in the floor of the bottom section, the apertures being positioned parallel to each other and parallel to the end walls, and a substantially circular aperture in the floor of the bottom section, the circular aperture being located near the first side wall.

When the top and bottom sections of the case are assembled, each of the end walls forms a surface having two rectangular apertures parallel to each other and a D-shaped aperture.

8 Claims, 10 Drawing Figures

CASE FOR ELECTRICAL MULTIPLE OUTLET

BACKGROUND OF INVENTION AND PRIOR ART STATEMENT

This invention relates in general to the electrical multiple outlets and in particular to an electrical multiple outlet of the type known as a cube tap.

U.S. Pat. No. 3,034,084 discloses a cube tap which utilizes a ground connection either in the form of a ground prong or a ground wire with a ground lug. The cube tap disclosed utilizes a two part plastic case which is held together with two screws. The two parts of the case are molded out of plastic or a similar non-conductive material after which some of the apertures must be cut into various faces of the cube tap. In order to provide the needed structural strength the walls of the case must be of a predetermined thickness. The relevance of the prior art indicated in the present specification should not be given a limited interpretation. A cited prior art item may be found to have relevance in a passage other than the one referred to, or to have relevance in a sense different than as stated.

OBJECT OF THE INVENTION

It is a general object of the present invention to provide a novel case for an electrical multiple outlet.

It is a more specific object of the present invention to provide an inexpensive, yet structurally strong, non-conductive case for use with an electrical multiple outlet.

It is yet another object of the present invention to provide a non-conductive case which is easier to manufacture and requires less material than previous cases for electrical multiple outlet.

BRIEF DESCRIPTION OF THE DRAWINGS

The features of the present invention which are believed to be novel are set forth with particularity in the appended claims. The invention together with further objects and advantages may best be understood by references to the following description taken in conjunction with the accompanying drawings, in the several figures of which like referenced numerals identify like elements, and in which:

DESCRIPTION OF THE PREFERRED EMBODIMENT

This invention pertains to a novel case for use with an electrical multiple outlet. Typically, electrical multiple outlets have three sets of contacts for accepting standard electrical plugs with or without ground prongs. The electrical multiple outlet has its own set of contact blades and ground prong for insertion into a standard wall socket. This allows three electrical plugs to tap power from one electrical wall socket.

The present invention will now be described. The present invention is an improved thin wall correlative case for use with an electrical multiple outlet having; a ground contact assembly having a ground prong and at least two ground contact elements, two live contact assemblies each having a live contact blade and at least two live contact elements, two insulative partitions for preventing contact between the grounding contact assembly and the two live contact assemblies. A means for holding the case together is provided. The correlative case comprises; a bottom section and a top section, each of the top and bottom sections having; a floor, first and second side walls, and first and second end walls, a receiving slot in the first end wall, the receiving slot having a rectangular notch in its bottom portion, a planar projection extending from the second end wall with a semi-circular notch in its far end and two rectangular notches positioned in the second end wall on either side of the planar projection; first and second substantially rectangular apertures in the floor of the bottom section, the apertures being positioned parallel to each other and parallel to the end walls and a substantially circular aperture in the floor of the bottom section, the circular aperture being located near a first side wall; and means for positioning the grounding contact assembly, the two live contact assemblies, and the two insulative partitions within the case. When the top and bottom sections of the case are assembled, each of the end walls forms a surface having two rectangular apertures parallel to each other and a D-shaped aperture. Also, when the multiple outlet is completely assembled, the ground prong and the two live contact blades extend through the circular aperture and the first and second rectangular apertures, respectively, in the floor of the bottom section. The ground contact elements align with the D-shaped apertures and the live contact elements align with the rectangular apertures in the end walls.

Figure 1:
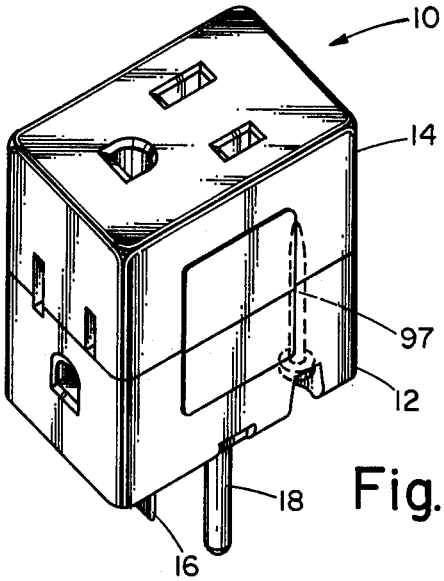
FIG. 1 is a perspective view of the present invention.

A preferred embodiment of the present invention is shown in FIG. 1. The correlative case of an electrical multiple outlet 10 has a bottom section 12 and top section 14. Two live contact blades 16 and a ground prong 18 extend from the bottom section 12. The configuration of the contact blades and ground prong are such that they mate with a standard electrical wall socket.

Figure 2:
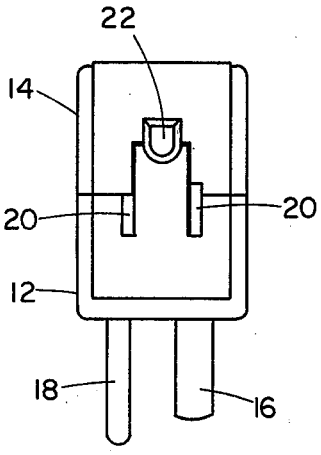
FIGS. 2 and 3 are end views of the present invention.
Figure 3:
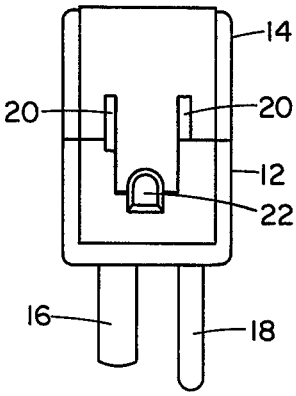
Figure 4:
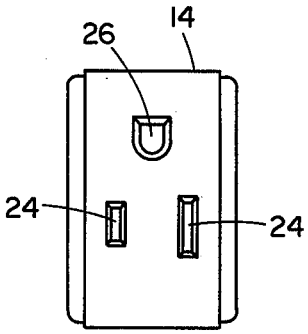
FIG. 4 is a top view of the present invention.

FIGS. 2 and 3 are end views of the FIG. 1 case. The opening in the ends of the case comprise rectangular apertures 20 and a D-shaped aperture 22. FIG. 4 is a top view of the FIG. 1 case showing similar rectangular apertures 24 and a D-shaped aperture 26. These apertures in the ends and top of the case are arranged in a pattern to accept a standard electrical plug. The rectangular apertures accept the live contact blades of the plug and the D-shaped aperture accepts the ground prong of the plug.

Figure 5:
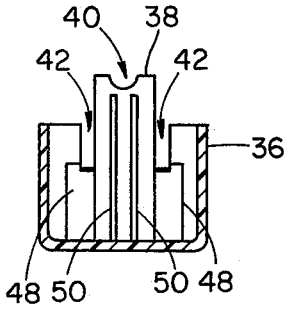
FIG. 5 is an end view of the top section of the case.
Figure 6:
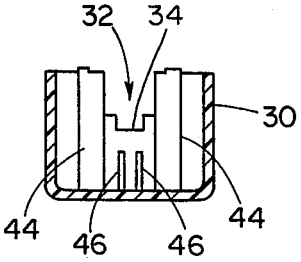
FIG. 6 is an end view of the bottom section of the case illustrating the correlative properties of the case.
Figure 7:
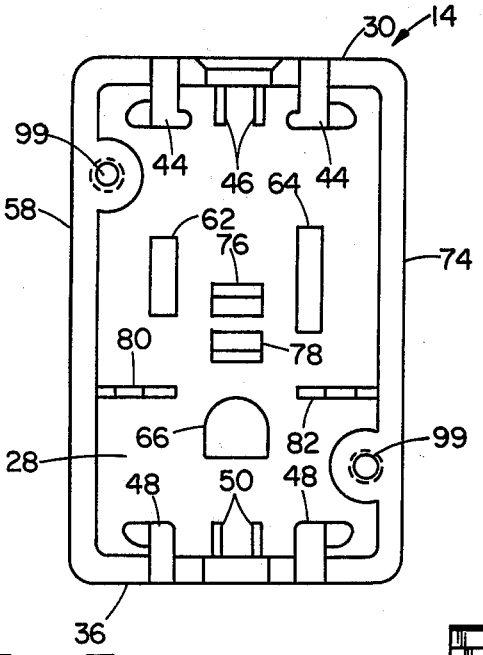
FIG. 7 is an interior view of the top section of the novel case.
Figure 8:
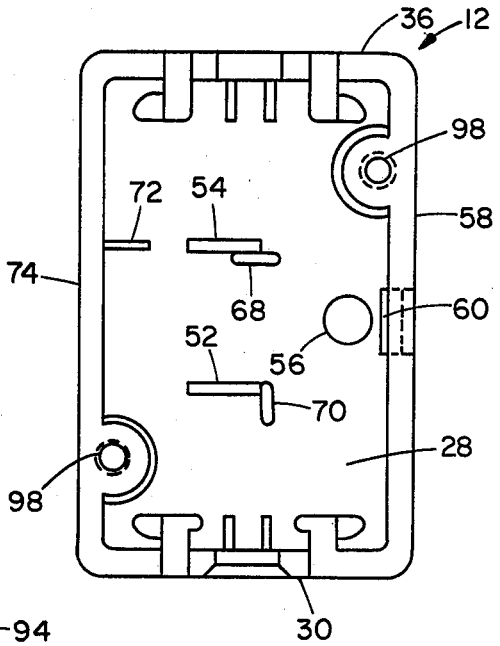
FIG. 8 is an interior view of the bottom section of the novel case.

FIGS. 5 and 6 are end views of the top section 14. The end views of the bottom section 12 are also identical in configuration. Therefore the end views shown in FIGS. 5 and 6 apply to either the top section 14 or the bottom section 12. When the top and bottom sections 12 and 14 are assembled the end sides fit together in a jig-saw like pattern. FIG. 7 shows an interior view of the top section 14 and FIG. 8 shows an interior view of the bottom section 12. The bottom section 12 and the top section 14 each have a floor 28, first and second side walls, 58 and 74, and first and second end walls, 30 and 36.

The following description applies to both the bottom section 12 and the top section 14. A receiving slot 32 in the first end wall 30 has a rectangular notch 34 in its bottom portion. A second end wall 36 has a planar projection 38 extending from it with a semi-circular notch 40 in its far end. Two rectangular notches 42 are positioned in the second end wall 36 on either side of the planar projection 38.

First and second live contact assembly positioning posts 44 extend from the floor 28 to substantially the top of the first end wall 30. These live contact assembly positioning posts 44 are positioned on the inside of the first end wall 30 and on either side of the receiving slot 32. First and second insulative partition ridges 46 extend from the floor 28 to approximately one-half of the distance to the rectangular notch 34 at the bottom of the receiving slot 32 on the inside of the first end wall 30.

First and second live contact positioning posts 48 extend from the floor 28 to substantially the bottom of each of the two rectangular notches 42 in the second end wall 36. The two live contact positioning posts 46 are positioned on the inside of the second end wall 36. First and second insulative partition ridges 50 extend from the floor 28 to substantially the bottom of the semi-circular notch 40 on the planar projection 38. The two insulative partition ridges 50 are positioned also on the inside of the second end wall 36.

The bottom section 12 has first and second substantially rectangular apertures 52 and 54 (See FIG. 8). The apertures 52 and 54 are positioned parallel to each other and parallel to the end walls 30 and 36. A substantially circular aperture 56 is located in the floor 28 of the bottom section 12 and near the first side wall 58. A ground slot 60 in the floor 28 of the bottom section 12 is even with the first side wall 58 and is located near the circular aperture 56.

Third and fourth substantially rectangular apertures 62 and 64 are located in the floor 28 of the top section 14 (See FIG. 7). A substantially D-shaped aperture 66 is also located in the floor 28 of the top section 14. The D-shaped aperture 66 is located near the second end wall 36.

A first contact positioning wall 70 is located on the floor 28 of the bottom section 12 near the first rectangular aperture 52. A second contact positioning wall 68 is located on the floor 28 of the bottom section 12 near the second rectangular aperture 54. The second contact positioning wall 68 is perpendicularly oriented to the first positioning wall 70. A third contact positioning wall 72 extends from the floor 28 of the bottom section 12 to the top of the second side wall 74 and is in alignment with the second rectangular aperture 54.

Fourth and fifth ground contact positioning walls 76 and 78 are spaced a predetermined distance apart and are located substantially in the center of the floor 28 of the top section 14. The fourth and fifth walls 76 and 78 are parallel to each other, and are also parallel to the end walls 30 and 36. Sixth and seventh contact positioning walls 80 and 82 are positioned on the first and second side walls 58 and 74 respectively. The sixth and seventh contact positioning walls 80 and 82 each extend from the floor 28 of the top section 14 to the top of each of the side walls 58 and 74. The sixth and seventh walls 80 and 82 are spaced such that they are located on a line between the D-shaped aperture 66 and the third and fourth rectangular apertures 62 and 64.

When the top and bottom sections 12 and 14 of the case are assembled each of the end walls 30 and 36 form a surface having two substantially rectangular apertures parallel to each other and a D-shaped aperture.

Figure 9:
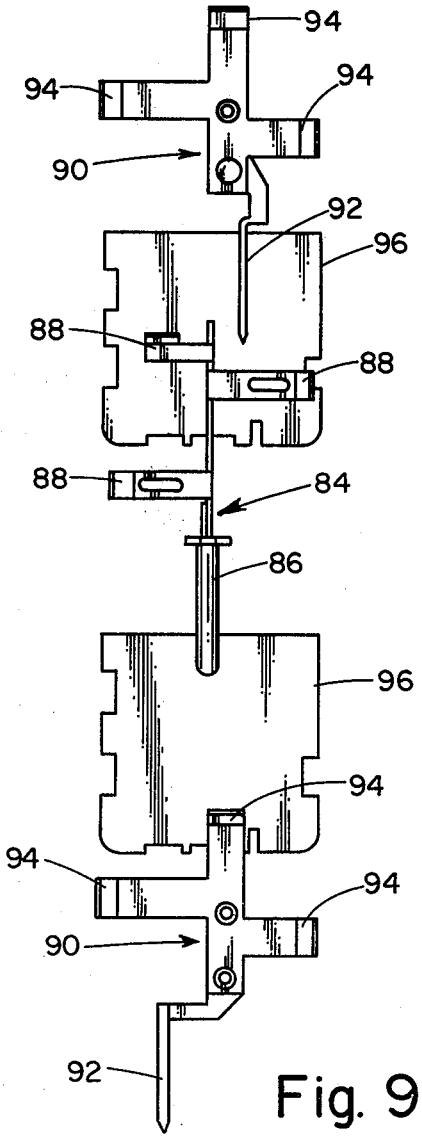
FIG. 9 is an exploded view of a grounding contact assembly, two line contact assemblies and two insulative partitions which are contained in a novel case.

FIG. 9 shows a grounding contact assembly 84 which has a ground prong 18 and three ground contact elements 88, the two live contact assemblies 90 each having a contact blade 16 and three live contact elements 94 and two insulative partitions 96 for preventing contact between the grounding contact assembly 84 and the two live contact assemblies 90.

Figure 10:
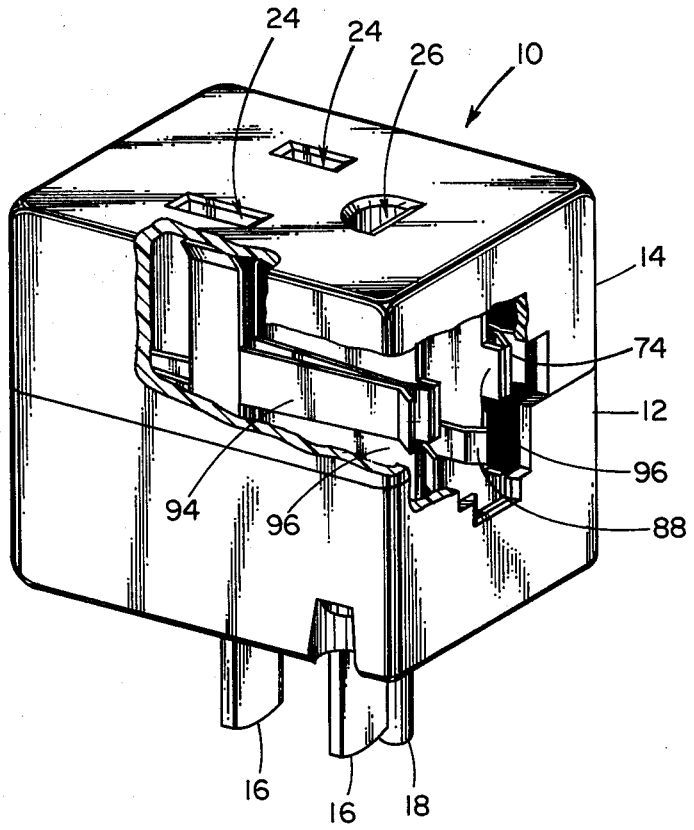
FIG. 10 is a cross-sectional view of the novel case illustrating the positioning of the grounding contact assembly, the two line contact assemblies and the two insulative partitions within the case.

When the multiple outlet 10 is completely assembled as shown in FIG. 10, the grounding prong 18 and the two live contact blades 16 extend through the circular aperture 56 and the first and second rectangular apertures 52 and 54, respectively, in the floor 28 of the bottom section 12. The ground contact elements 88 align with the D-shaped aperture 26 in the floor 28 of the top section 14 and with the D-shaped apertures formed when the end walls 30 and 36 are assembled. Similarly, the live contact elements 94 align with the rectangular apertures 24 in the floor 28 of the top section 14 and with the rectangular apertures formed when the end walls 30 and 36 are assembled.

The top and bottom sections 14 and 12 of the multiple outlet 10 may be held together by a variety of means. In the preferred embodiment two screws 97 are inserted through apertures 98 in the bottom section 12 and extend into threaded apertures 99 in the top section 14.

The invention is not limited to the particular details of the apparatus depicted and other modifications and applications are contemplated. Certain other changes may be made in the above-described apparatus without departing from the true spirit and scope of the invention herein involved. It is intended therefore that the subject matter in the above depiction shall be interpreted as illustrative and not in a limiting sense.

What is claimed is:

1. An improved thin wall correlative case for use with an electrical multiple outlet having; a grounding contact assembly having a ground prong and at least two ground contact elements, two live contact assemblies each having a live contact blade and at least two live contact elements, two insulative partitions for preventing contact between the grounding contact assembly and the two live contact assemblies, and a means for holding said case together, said correlative case comprising:

a bottom section and a top section, each of said top and bottom sections having;

a floor, first and second side walls, and first and second end walls, a receiving slot in said first end wall, said receiving slot having a rectangular notch in its bottom portion, a planar projection extending from said second end wall with a semi-circular notch in its far end and two rectangular notches positioned in said second end wall on either side of said planar projection;

first and second substantially rectangular apertures in said floor of said bottom section, said apertures being positioned parallel to each other and parallel to said end walls, and a substantially circular aperture in said floor of said bottom section, said circular aperture being located near said first side wall;

means for positioning the grounding contact assembly, the two live contact assemblies, and the two insulative partitions within said case; and wherein, when said top and bottom sections of said case are assembled, each of said end walls forms a surface having two rectangular apertures parallel to each other and a D-shaped aperture, and also wherein, when said multiple outlet is completely assembled, said ground prong and said two live contact blades extend through said circular aperture and said first and second rectangular apertures, respectively, in said floor of said bottom section, and wherein said ground contact elements align with said D-shaped apertures and said live contact elements align with said rectangular apertures in said end walls.

2. The apparatus defined in claim 1 wherein said case also comprises third and fourth rectangular apertures, parallel to each other, and a D-shaped aperture in said floor of said top section, said D-shaped aperture being located near said second end wall, wherein one of said ground contact elements aligns with said D-shaped aperture in said floor of said top section and said live contact elements align with said third and fourth rectangular apertures in said floor of said top section.

3. An improved thin wall correlative case for use with an electrical multiple outlet having; a grounding contact assembly having a ground prong or ground clip and three ground contact elements, two live contact assemblies each having a live contact blade and three live contact elements, two insulative partitions for preventing contact between the grounding contact assembly and the two live contact assemblies, and a means for holding said case together, said correlative case comprising:

a bottom section and a top section, each of said top and bottom sections having;

a floor, first and second side walls, and first and second end walls, a receiving slot in said first end wall, said receiving slot having a rectangular notch in its bottom portion, a planar projection extending from said second end wall with a semi-circular notch in its far end, and two rectangular notches positioned in said second end wall on either side of said planar projection;

first and second substantially rectangular apertures in said floor of said bottom section, said apertures being positioned parallel to each other and parallel to said end walls, and a substantially circular aperture in said floor of said bottom section, said circular aperture being located near said first side wall and a ground slot in said floor of said bottom section, even with said first side wall, and near said circular aperture;

third and fourth substantially rectangular apertures, parallel to each other, and a substantially D-shaped aperture in said floor of said top section, said D-shaped aperture being located near said second end wall;

means for positioning the grounding contact assembly, the two live contact assemblies, and the two insulative partitions within said case; and wherein, when said top and bottom sections of said case are assembled, each of said end walls forms a surface having two rectangular apertures parallel to each other and a D-shaped aperture, and also wherein, when said multiple outlet is completely assembled, said ground prong extends through said circular aperture or said ground clip extends through said ground slot and said two live contact blades extend through said first and second rectangular apertures in said floor of said bottom section, and wherein said ground contact elements align with said D-shaped apertures and said live contact elements align with said rectangular apertures in said end walls and in said floor of said top section.

4. The apparatus defined in claim 1 wherein said means for positioning the grounding contact assembly, the two live contact assemblies, and the two insulative partitions within the case comprises;

on both said top section and said bottom section first and second live contact assembly positioning posts on the inside of said first end wall extending from said floor to substantially the top of said first end wall and positioned on either side of said receiving slot;

on both said top section and said bottom section first and second insulative partition ridges on the inside of said first end wall extending from said floor to approximately one-half of the distance to said rectangular notch at the bottom of said receiving slot;

on both said top section and said bottom section third and fourth live contact positioning posts on the inside of said second end wall extending from said floor to substantially the bottom of each of said two rectangular notches in said second end wall;

on both said top section and said bottom section third and fourth insulative partition ridges on the inside of said second end wall and on said planar projection extending from said floor to substantially the bottom of said semi-circular notch on said planar projection;

a first contact positioning wall near said first rectangular aperture in said floor of said bottom section and parallel to said side walls;

a second contact positioning wall near said second rectangular aperture in said floor of said bottom section and perpendicular to said first positioning wall;

a third contact positioning wall on said second side wall extending from said floor of said bottom section to the top of said second side wall and in alignment with said second rectangular aperture;

fourth and fifth ground contact positioning walls spaced a predetermined distance apart and located substantially in the center of said floor of said top section, said fourth and fifth walls being parallel to each other and parallel to said end walls; and sixth and seventh contact positioning walls on said first and second side walls, respectively, extending from said floor of said top section to the top of said side walls, said sixth and seventh walls being spaced such that they are located on a line between said D-shaped aperture and said third and fourth rectangular apertures.

5. An improved thin wall correlative case for use with an electrical multiple outlet having; a ground contact assembly having a ground prong and three ground contact elements, two live contact assemblies each having a live contact blade and three live contact elements, two insulative partitions for preventing contact between the grounding contact assembly and the two live contact assemblies, and a means for holding said case together, said correlative case comprising:

a bottom section and a top section, each of said top and bottom section having:

a floor, first and second side walls, and first and second end walls, a receiving slot in said first end wall, said receiving slot having a rectangular notch in its bottom portion, a planar projection extending from said second end wall with a semi-circular notch in its far end, and two rectangular notches positioned in said second end wall on either side of said planar projections;

first and second live contact assembly posts on the inside of said first end wall extending from said floor to substantially the top of said first end wall and positioned on either side of said receiving slot;

first and second insulative partition ridges on the inside of said first end wall extending from said floor to approximately one half of the distance to said rectangular notch at the bottom of said receiving slot;

third and fourth live contact positioning posts on the inside of said second end wall extending from said floor to substantially the bottom of each of said two rectangular notches in said second end wall;

third and fourth insulative partition ridges on the inside of said second end wall and on said planar projection extending from said floor to substantially the bottom of said semi-circular notch on said planar projection;

first and second substantially rectangular apertures in said floor of said bottom section, said apertures being positioned parallel to each other and parallel to said end walls, and a substantially circular aperture in said floor of said bottom section, said circular aperture being located near said first side wall and a ground slot in said floor of said bottom section, even with said first side wall and near said circular aperture;

a first contact positioning wall on said floor of said bottom section near said first rectangular aperture and parallel to said side walls;

a second contact positioning wall on said floor of said bottom section near said second rectangular aperture and perpendicular to said first positioning wall;

a third contact positioning wall on said second side wall extending from said floor of said bottom section to the top of said second side wall and in alignment with said second rectangular aperture;

third and fourth rectangular apertures, parallel to each other, and a D-shaped aperture in said floor of said top section, said D-shaped aperture being located near said second end wall;

fourth and fifth ground contact positioning walls spaced a predetermined distance apart and located substantially in the center of said floor of said top section, said fourth and fifth walls being parallel to each other and parallel to said end walls; and sixth and seventh contact positioning walls on said first and second side walls, respectively, extending from said floor of said top section to the top of said side walls, said sixth and seventh walls being spaced such that they are located on a line between said D-shaped aperture and said third and fourth rectangular apertures, wherein, when said top and bottom sections of said case are assembled, each of said end walls forms a surface having two rectangular apertures parallel to each other and a D-shaped aperture, and also wherein, when said multiple outlet is completely assembled, said grounding prong and said two live contact blades extend through said circular aperture and said first and second rectangular apertures, respectively, in said floor of said bottom section, and wherein said ground contact elements align with said D-shaped apertures and said live contact elements align with said rectangular apertures in said end walls and in said floor of said top section.

6. An improved thin wall correlative case for use with an electrical multiple outlet having; a grounding contact assembly having a ground clip and three ground contact elements, two live contact assemblies each having a live contact blade and three live contact elements, two insulative partitions for preventing contact between the grounding contact assembly and the two live contact assemblies, and a means for holding said case together, said correlative case comprising:

a bottom section and a top section, each of said top and bottom sections having;

a floor, first and second side walls, and first and second end walls, a receiving slot in said first end wall, said receiving slot having a rectangular notch in its bottom portion, a planar projection extending from said second end wall with a semi-circular notch in its far end, and two rectangular notches positioned in said second end wall on either side of said planar projection;

first and second substantially rectangular apertures in said floor of said bottom section, said apertures being positioned parallel to each other and parallel to said end walls, and a substantially circular aperture in said floor of said bottom section, said circular aperture being located near said first side wall and a ground slot in said floor of said bottom section, even with said first side wall, and near said circular aperture;

means for positioning the grounding contact assembly, the two live contact assemblies, and the two insulative partitions within said case; and wherein, when said top and bottom sections of said case are assembled, each of said end walls forms a surface having two rectangular apertures parallel to each other and a D-shaped aperture, and also wherein, when said multiple outlet is completely assembled, said ground clip and said two live contact blades extend through said ground slot and said first and second rectangular apertures, respectively, and wherein said ground contact elements align with said D-shaped apertures and said live contact elements align with said rectangular apertures in said end walls.

7. The apparatus defined in claim 6 wherein said case also comprises third and fourth rectangular apertures, parallel to each other, and a D-shaped aperture in said floor of said top section, said D-shaped aperture being located near said second end wall, wherein one of said ground contact elements aligns with said D-shaped aperture in said floor of said top section and said live contact elements align with said third and fourth rectangular apertures in said floor of said top section.

8. An improved thin wall correlative case for use with an electrical multiple outlet having; a grounding contact assembly having a ground clip and three ground contact elements, two live contact assemblies each having a live contact blade and three live contact elements, two insulative partitions for preventing contact between the grounding contact assembly and the two live contact assemblies, and a means for holding said case together, said correlative case comprising:

a bottom section and a top section, each of said top and bottom section having;

a floor, first and second side walls, and first and second end walls, a receiving slot in said first end wall, said receiving slot having a rectangular notch in its bottom portion, a planar projection extending from said second end wall with a semi-circular notch in its far end, and two rectangular notches positioned in said second end wall on either side of said planar projection;

first and second live contact assembly positioning posts on the inside of said first end wall extending from said floor to substantially the top of said first end wall and positioned on either side of said receiving slot;

first and second insulative partition ridges on the inside of said first end wall extending from said floor to approximately one half of the distance to said rectangular notch at the bottom of said receiving slot;

third and fourth live contact positioning posts on the inside of said second end wall extending from said floor to substantially the bottom of said semi-circular notch on said planar projection;

third and fourth insulative partition ridges on the inside of said second end wall and on said planar projection extending from said floor to substantially the bottom of said semi-circular notch on said planar projection;

first and second rectangular apertures in said floor of said bottom section, said apertures being positioned parallel to each other and parallel to said end walls, and a circular aperture in said floor of said bottom section, said circular aperture being located near said first side wall and a ground slot in said floor of said bottom section, even with said first side wall, and near said circular aperture;

a first contact positioning wall on said floor of said bottom section near said first rectangular aperture and parallel to said side walls;

a second contact positioning wall on said floor of said bottom section near said second rectangular aperture and perpendicular to said first positioning wall;

a third contact positioning wall on said second side wall extending from said floor of said bottom section to the top of said second side wall and in alignment with said second rectangular aperture;

third and fourth rectangular apertures, parallel to each other, and a D-shaped aperture in said floor of said top section, said D-shaped aperture being located near said second end wall;

fourth and fifth ground contact positioning walls spaced a predetermined distance apart and located substantially in the center of said floor of said top section, said fourth and fifth walls being parallel to each other and parallel to said end walls; and sixth and seventh contact positioning walls on said first and second side walls, respectively, extending from said floor of said top section to the top of said side walls, said sixth and seventh walls being spaced such that they are located on a line between said D-shaped apertures and said third and fourth rectangular apertures, wherein, when said top and bottom sections of said case are assembled, each of said end walls forms a surface having two rectangular apertures parallel to each other and a D-shaped aperture, and also wherein, when said multiple outlet is completely assembled, said ground clip and said two live contact blades extend through said ground slot and said first and second rectangular apertures, respectively, in said floor of said bottom section, and wherein said ground contact elements align with said D-shaped apertures and said live contact elements align with said rectangular apertures in said end walls and in said floor of said top section.

* * * * *